United States Patent [19]

Scheindel

[11] Patent Number: 5,065,900

[45] Date of Patent: Nov. 19, 1991

[54] BARRIER CAN PREFILL SEAL

[76] Inventor: Christian T. Scheindel, Star Route-Ridge Rd., Randolph Center, Vt. 05061

[21] Appl. No.: 464,114

[22] Filed: Jan. 12, 1990

[51] Int. Cl.[5] ..... B65D 83/14

[52] U.S. Cl. ..... 222/1; 222/386; 222/389; 277/DIG. 6

[58] Field of Search ..... 222/386, 386.5, 389, 222/1; 53/470; 215/233; 277/1, 135, 72 FM, DIG. 6

[56] References Cited

U.S. PATENT DOCUMENTS

| | | | |
|---|---|---|---|
| 3,233,791 | 2/1966 | Miles | 222/389 |
| 3,354,792 | 11/1967 | Fuchs | 277/135 |
| 3,381,863 | 5/1968 | Towns | 222/386.5 |
| 3,563,258 | 2/1971 | Hechler | 222/389 |

FOREIGN PATENT DOCUMENTS

| | | | |
|---|---|---|---|
| 8301244 | 4/1983 | European Pat. Off. | 222/389 |

*Primary Examiner*—Kevin P. Shaver
*Assistant Examiner*—Philippe Derakshani
*Attorney, Agent, or Firm*—McAulay Fisher Nissen Goldberg & Kiel

[57] ABSTRACT

A method for preparing and improving a container for dispensing a product under pressure, using a piston to separate gas and product. This piston is free to move along a can side wall. Free pistons, as they are usually called, have not been functional for many products, notably those which readily absorb gases. To prevent gas migration by passage of gas around the piston, a material or prefill is introduced through the top opening into the area of can above a piston. The prefill is then forced down under pressure along the margin of piston and can wall prior to the filling of the can. The amount of prefill depends on piston diameter and may vary from three grams for a 35MM piston up to ten grams for a 53MM size piston.

9 Claims, 3 Drawing Sheets

BARRIER CAN PREFILL SEAL

BRIEF DESCRIPTION

1. There are a number of special containers for dispensing products under pressure on the market in which the product and propellant are kept separated. There is the collapsible bag type, the expandable bag type using CO2 pellets, and the piston type. The piston may be of two types, the free piston and a piston which fits tightly with a well engaging skirt. In the piston can the container is divided into two chambers by an internal piston. The product is held on one side of the piston and the propellant on the other. Under pressure of the propellant, the piston forces the product from the container. This invention relates to a prefill method used in a container designed to dispense its contents under pressure. Particularly but not exclusively the invention is concerned with dispensing viscous material as well as liquids under pressure of a propellant. More specifically the invention relates to a free piston in which the piston is sealed with a secondary product other than the material dispensed.

2. Much emphasis has previously been placed on primary permeation which is gas going through the piston and secondary permeation which is gas going up between piston and can side wall. Pistons which use the product as the seal between can and piston are known in the art and are called free pistons. Pistons have been designed to minimize secondary permeation by only having minimal gap between piston and can side wall. Water based products such as shave gel, caulking compound and cheese have been successfully marketed for years with excellent shelf life using a free piston. Products with solvent contents like mineral spirits or III trichlorethane while forming a seal between piston and can also provide a path for the gas to be absorbed into the product. Solubilities of compressed gases in solvents are well documented as outlined in "Handbook of Aerosol Technology Second Addition". There are also products which although they do not contain a high percent of solvents, have by nature of the material, a high gas transmission rate. A material exhibiting this latter characteristic is silicone sealant. Each of these properties in products provide a continuous path for the gas to migrate up the side wall into the product side of the piston causing adulteration of products to be dispensed and giving them a foamy appearance. An object of the present invention is to provide a seal for a free piston with a material which will not absorb gas or transmit the gas into the product side. We will refer to this material as a pre-fill. Preferably the piston should be high barrier piston. These include a multi-layer material such as: polypropelene, eval, polypropelene, pressure formed into a piston which will create a barrier to gas transmission or an injection molded piston with high barrier properties. The piston should not be a tight piston, but free to move along the can side wall in order to permit the pre-fill material to flow into the gap between the piston and can. Preferably the material is a copolymer composed predominantly of high molecular weight mono-olefins. These materials are known to resist oxidation, are completely hydrophobic and are impermeable to water, vapor and gases. A product name for this copolymer is Polybutene, which can be used by itself or have paraffin added to form a paste. The material selected should be heated so to decrease its viscosity and cause it to flow. In the liquid stage the sealant will flow down and around the piston more easily forming a seal upon cooling. It should be noted that the seal, when cool, should be compatible with the material with which it comes in contact. The material should not be a liquid state when cool but should become a paste or slurry when sealing the piston.

The above material or combinations of materials is an example, since there are other polymers and sealants that could be used to prevent gas migration into the product. It should also be noted that the pre-fill may also be introduced as a paste and pushed down around the piston under pressure forming a seal.

DESCRIPTION OF THE PREFERRED EMBODIMENT

Figure 1:
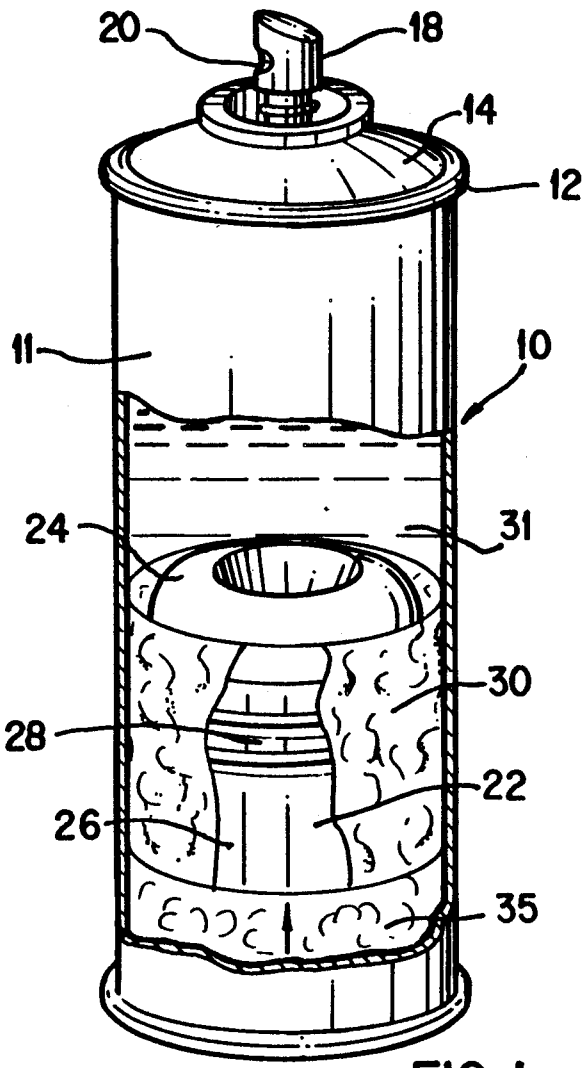
FIG. 1 is a side elevation view of a container having a piston which is provided with a prefill sealant material.

Referring to the drawings, the reference number 10 denotes a pressurized container for dispensing materials, Container 10 is usable with materials of varying viscosities indepentent of piston sidewall clearance. FIG. 1 shows a container 10 which includes a substantially cylindrical body 11 closed at its dispensing end 12 by a cap 14 and at the other end by a bottom wall 16 all of which are secured together and sealed with liquid tight integrity. A dispensing nozzle 18 is carried in cap 14 and includes valve means (not shown) well known in the art. When nozzle 18 is depressed the contents of container 10 may escape through orifice 20 in nozzle 18.

A piston 22 is provided separating product 31 from propellant 35. Piston is longitudinally slidable within container 10. Piston 22 includes a generally annular sidewall 26 which is closed at its upper end by a barrier wall 24.

Piston 22 is formed with at least one annular step 28 on its sidewall 26 in which the prefill sealant 30 will flow in order to seal the piston. As the product is discharged from orifice 20 the piston will move up along the can side wall moving the prefill sealant 30 with it, thereby providing a continuous seal.

Figure 2:
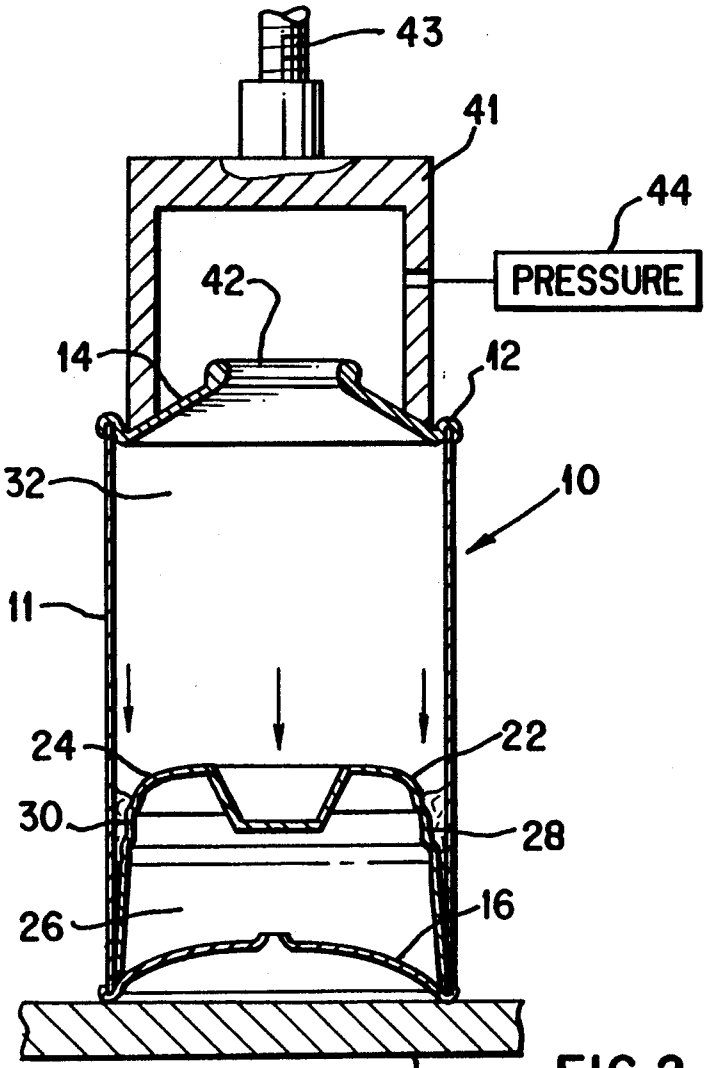
FIG. 2 is a fragmentary view of the container of FIG. 1 being filled with compressed air.

FIG. 2 shows a clamped can 10. Clamp 41 has a cylindrical lower portion for engaging can top wall 14. This portion being formed with opening 42 to introduce pressure. The clamp is connected by a rod 43 suitable means for moving it up and down. When the clamp engages can top wall 14 against support plate 38 fluid pressure 44 shown schematically in FIG. 2 such as compressed air is introduced into opening 42 and into can body 32, thereby forcing prefill sealant down around piston into sidewall 26.

Figure 3:
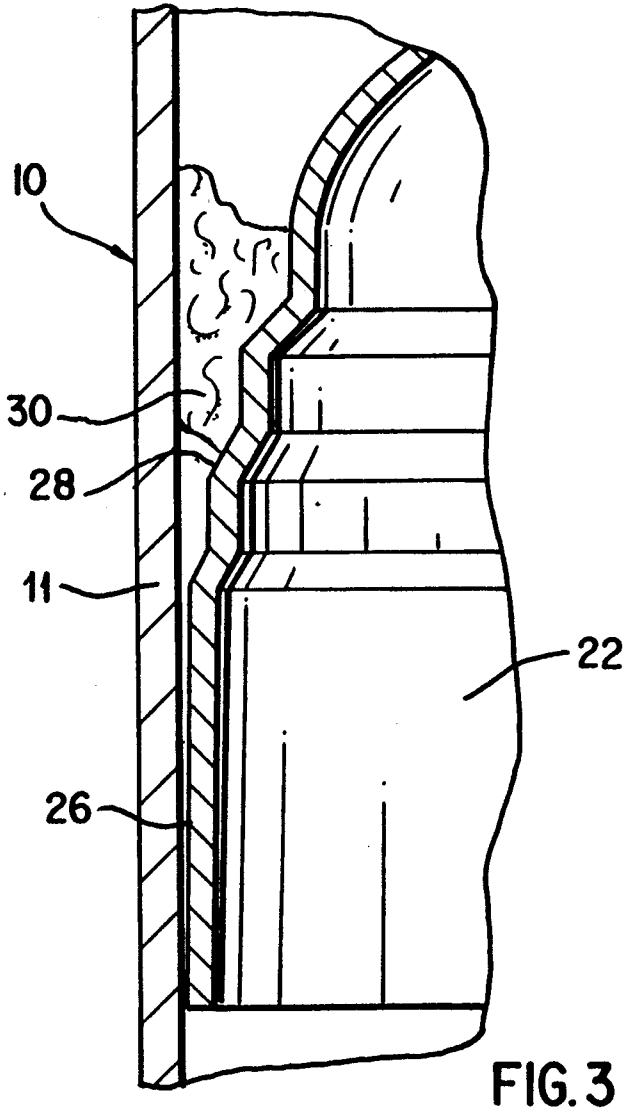
FIG. 3 is a fragmentary enlarged view of FIG. 1 showing the prefill sealant in its nonflowing condition.

FIG. 3 is a fragmentary enlarged view of piston 22 in can 10 showing prefill sealant 30 before being forced down between piston side wall 26 and container cylindrical body 11.

Figure 4:
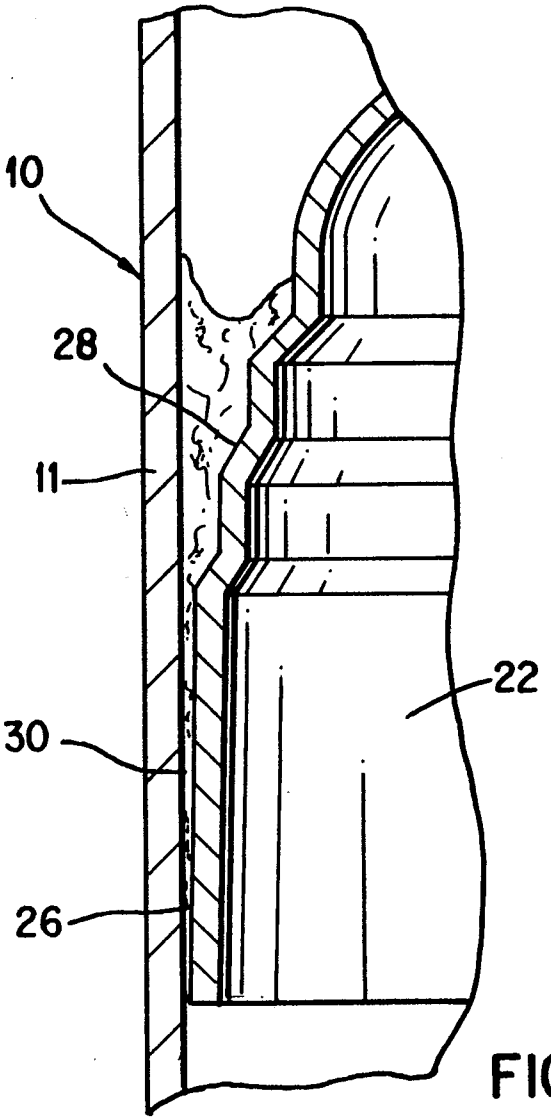
FIG. 4 is a fragmentary enlarged view of Figure showing the prefill sealant flowing between the piston and container wall.

FIG. 4 is a fragmentary enlarged view of piston 22 in can 10 showing prefill sealant 30 forced down between piston side wall 26 and container cylindrical body 11.

Figure 5:
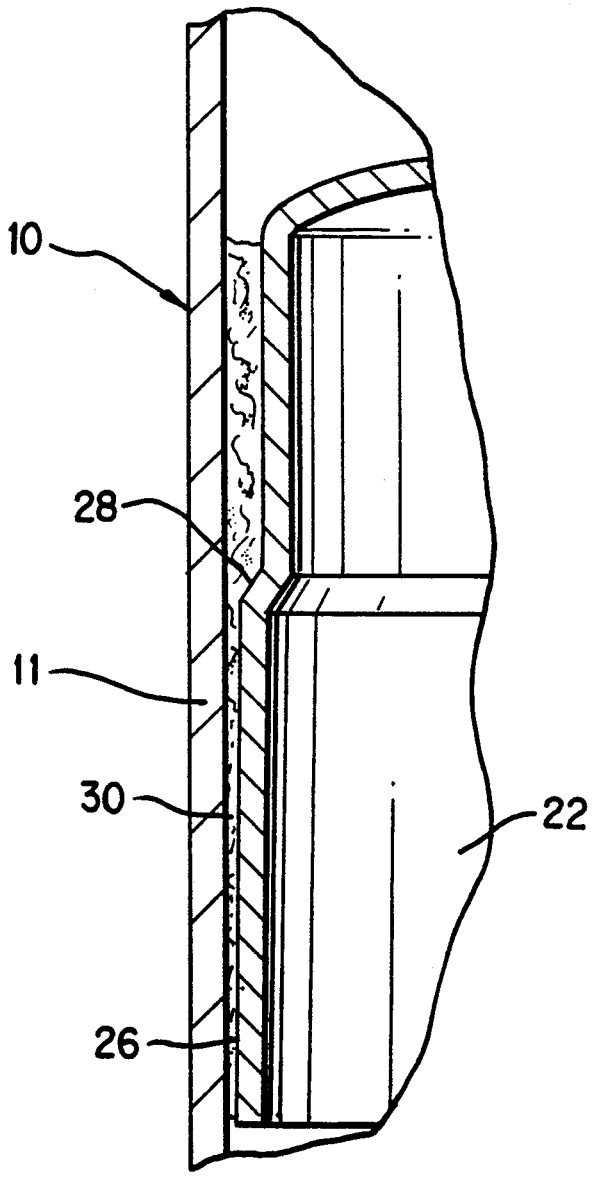
FIG. 5 is a view analogous to FIG. 4 for an alternative embodiment of the piston.

FIG. 5 is a view analogous to FIG. 4 showing another embodiment of a sealed piston in accordance with the present invention.

What is claimed is:

1. A pressurized piston operated product dispensing container having a cylindrical body, a bottom wall and a valve cap within which a cup shaped annular free piston is positioned to divide the container into an upper product containing chamber and a lower propellent containing chamber, the improvement in a sealing mechanism comprising:

said piston having an annular cylindrical sidewall with an outer diameter less than the inner diameter of said cylindrical body to provide an annular gap between piston sidewall and body wall, a sealant material, distinct from the product in the upper chamber, filling said annular gap between the sidewall of said piston and the sidewall of said can, said sealant material substantially preventing propellent from migrating around the wall of said piston into the product in said upper chamber, said sealant material being sufficiently fluid to provide a base on which said piston rides up when product is dispensed.

2. The improved product dispensing container of claim wherein:

said piston has upper and lower sidewall zones, said upper zone being spaced from said can sidewall by a distance substantially greater than the spacing between said lower sidewall zone and said can sidewall to provide upper and lower annular gaps, said sealant material being held in both of said annular gaps and being provided by said upper gap as a reservoir to said lower gap when said piston travels up within said container as product is being dispensed.

3. The improved container of claim 2 wherein: some of said sealant material is carried up with said piston when said piston moves as product is dispensed.

4. The improved container of claim 3 wherein: said piston is formed of a material with high barrier properties.

5. A method of dispensing for a pressurized piston operated product dispensing container having a free piston that divides the container as an upper product containing chamber and a lower propellent containing chamber and in which the piston has a sidewall with an outer diameter of less than the inner diameter of the container body to provide an annular gap between the piston sidewall and the container body, the improvement in providing a seal within said annular gap to prevent propellent from migrating through said annular gap from the propellent chamber to the product chamber while providing a base on which the piston can move up within said chamber when product is dispensed comprising the step of:

introducing a sealing material in said annular gap prior to filling the container with the product to be dispensed, said sealing material being other than the product to be dispensed and having characteristics of substantial impermeability to the propellant and sufficient fluidity to provide a base on which the piston can move when product is dispensed.

6. The method of claim 5 further comprising the steps of:

heating said sealing material prior to said step of introducing in order to decrease its viscosity, and cooling said sealing material after said step of introducing to restore its viscosity.

7. The method of claim 5 further comprising the step of:

providing a reservoir of said sealing material along an upper portion of the sidewall of said piston.

8. The method of claim 5 wherein:

said step of introducing comprises forcing said sealant under pressure into said annular gap prior to introducing product into said product chamber.

9. The method of claim 6 further comprising the step of:

providing a reservoir of said sealing material along an upper portion of the sidewall of said piston.

* * * * *